United States Patent [19]

Knutson

[11] 3,961,561

[45] June 8, 1976

[54] PROPORTIONAL FORCE AMPLIFIER

[75] Inventor: Dale A. Knutson, Oconomowoc, Wis.

[73] Assignee: Applied Power Inc., Milwaukee, Wis.

[22] Filed: Nov. 8, 1971

[21] Appl. No.: 196,495

[52] U.S. Cl. ..... 91/378; 91/416; 91/417 R; 91/431

[51] Int. Cl.[2] ..... F15B 9/10; F15B 15/17

[58] Field of Search ..... 91/378, 416, 417, 235, 91/321, 431

[56] References Cited

UNITED STATES PATENTS

| | | | |
|---|---|---|---|
| 773,365 | 10/1904 | Atkins | 91/416 X |
| 1,533,767 | 4/1925 | Schmidt | 91/378 X |
| 1,950,474 | 3/1934 | Brown | 91/378 X |
| 2,007,423 | 7/1935 | Davis | 91/431 X |
| 2,349,804 | 5/1944 | Sorensen | 91/378 |
| 2,602,437 | 7/1952 | Tancred | 91/378 X |
| 2,651,316 | 9/1953 | Fageol | 91/378 X |
| 2,681,043 | 6/1954 | Irwin | 91/378 X |
| 2,979,080 | 4/1961 | Hewitt | 137/625.68 |
| 3,017,750 | 1/1962 | Kempson | 91/378 X |
| 3,099,940 | 8/1963 | Leduc | 91/378 X |
| 3,145,624 | 8/1964 | Parks et al. | 91/417 X |
| 3,148,592 | 9/1964 | Schultz et al. | 91/431 X |
| 3,390,612 | 7/1968 | Wills | 91/417 X |
| 3,465,645 | 9/1969 | Mala | 91/431 X |

FOREIGN PATENTS OR APPLICATIONS

| | | | |
|---|---|---|---|
| 1,215,639 | 11/1959 | France | 91/378 |

*Primary Examiner*—Irwin C. Cohen
*Attorney, Agent, or Firm*—James E. Nilles

[57] ABSTRACT

A proportional force amplifier having a cylinder separated by a piston assembly into a pressure chamber, a control chamber and a reservoir chamber, a spool valve mounted for axial movement within a bore in said piston assembly to selectively connect the control chamber to either the pressure chamber or the reservoir chamber, the piston assembly moving in response to the change in pressure between the pressure chamber and the control chamber a distance equal to the distance of movement of the spool valve, the spool valve being connected for actuation by a resilient compensating rod and being pressure balanced.

10 Claims, 4 Drawing Figures

PROPORTIONAL FORCE AMPLIFIER

BACKGROUND OF THE INVENTION

Proportional force amplifiers of the type contemplated herein are used to provide equal amounts of movement between the input device and the output device at a substantially increased force output. Generally a 100 to one or greater force relationship is contemplated. The amount of input force can be affected by any forces which resist the movement of the spool valve, such as friction due to a lack of concentricity with the bore of the piston or variation in pressures which are on the ends of the spool valve. Seal failures have also been encountered where the seals are subjected to high working pressures.

SUMMARY OF THE INVENTION

The proportional force amplifier of the present invention is provided with improved response characteristics to the input forces with a corresponding improvement in the output response of the amplifier. This has been achieved by eliminating or reducing the stray forces which adversely effect the movements of the spool valve. The spool valve is pressure balanced by subjecting the ends of the spool valve to the same atmospheric pressure. The piston assembly is also statically pressure balanced at all times so that it remains in the null position regardless of any change in system pressure. Seal failures have been eliminated by isolating the spool valve seal and the actuating rod seal from system fluid pressure.

Other objects and advantages will become apparent from the following detailed description when read in connection with the accompanying drawings.

DESCRIPTION OF THE INVENTION

Figure 1:
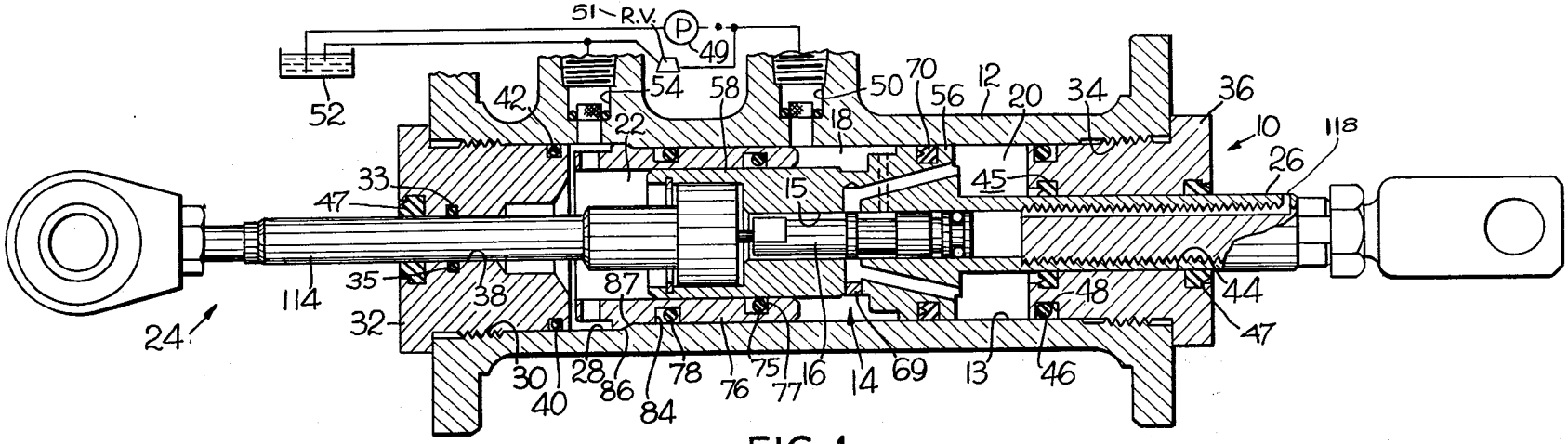
FIG. 1 is a side view in section showing the proportional force amplifier of this invention.

The proportional force amplifier 10 of this invention as shown in FIG. 1 generally includes a housing 12 having a cylindrical bore 13 and a piston assembly 14 mounted for axial movement in the bore 13. A spool valve 16 is mounted for movement within a bore 15 in the piston assembly 14 to control the flow of pressure fluid from a pressure chamber 18 to a control chamber 20 and from the control chamber 20 to a reservoir chamber 22. The spool valve 16 is moved in response to movement of an input mechanism 24 and the piston assembly 14 moves a distance equal to the distance of motion of the spool valve 16. The force provided by the motion of the piston assembly 14 is transmitted to the device to be activated by means of a rod 26 connected to the piston assembly 14 which extends outward from the housing 12.

More specifically, housing 12 includes the cylindrical bore 13 which has a threaded section 30 at one end to receive an end cap 32 and a threaded section 34 at the other end to receive an end cap 36. The end cap 32 is provided with a central bore 38 and is sealed in the bore 13 by means of an O-ring seal 40 provided in an annular groove 42 in the outer periphery of the end cap 32. The end cap 36 is provided with a central bore 44 and is sealed in the cylindrical bore 13 by means of an O-ring seal 46 positioned within an annular groove 48 provided in the outer periphery of the end cap. A counterbore 28 is provided in the threaded end 30 of the bore 13.

Fluid pressure is supplied to the bore 13 through an inlet port 50 from a pressure source such as a pump 49. Fluid in the bore 13 is returned to a tank or reservoir 52 through an outlet port 54. A constant predetermined maximum pressure of fluid is maintained at the inlet port 50 by means of a relief valve 51 which connects the discharge line 53 from the pump 49 to the reservoir 52.

Piston Assembly

Figure 2:
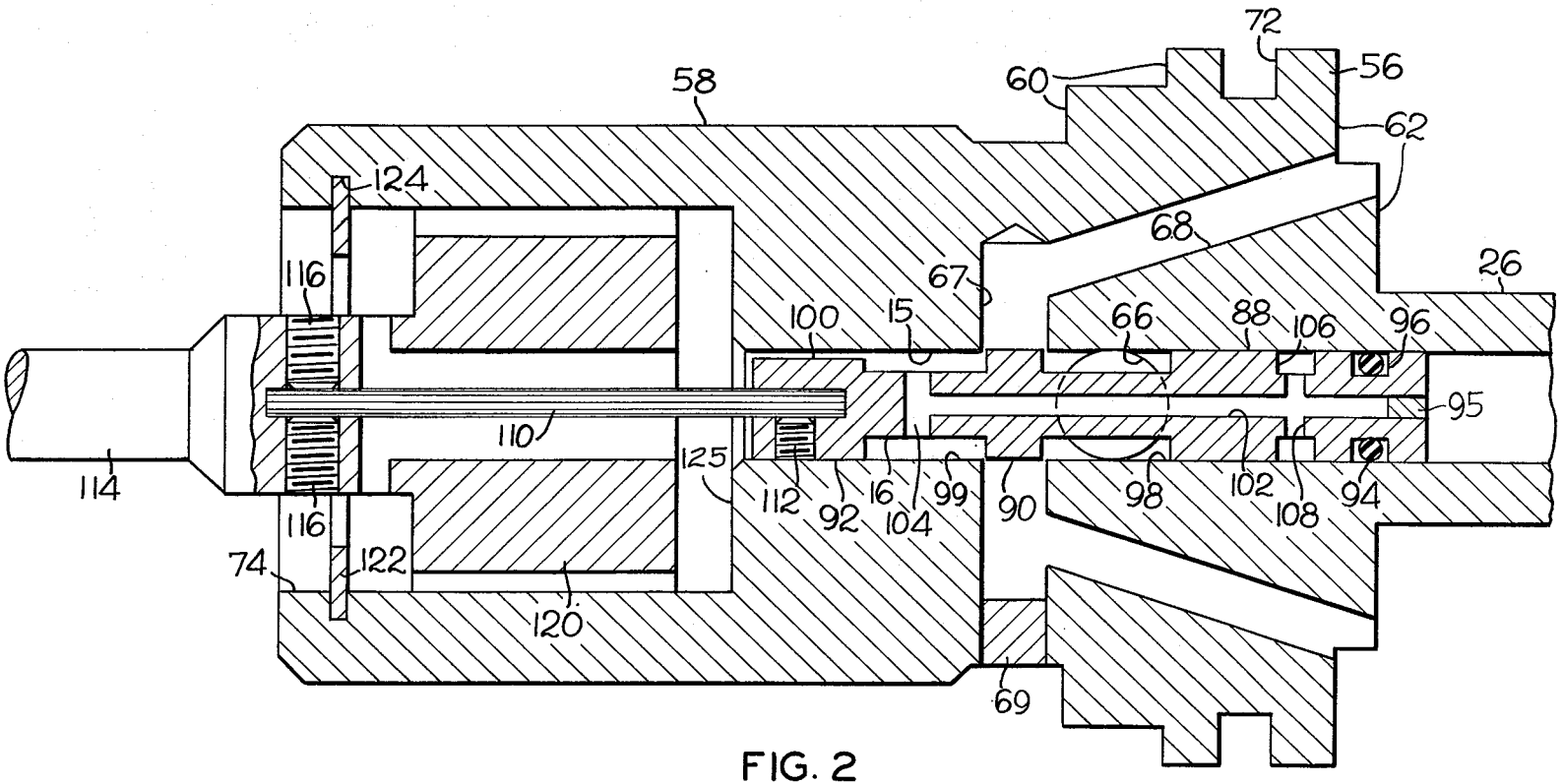
FIG. 2 is an enlarged view of a portion of the proportional force amplifier showing the control valve.

The piston assembly 14 includes a piston head 56, a piston rod 58 and the rod or bar 26. The piston head 56, as seen in FIG. 2, is provided with a working surface 60 and a control surface 62. The cross-sectional area of the working surface 60 is proportionately smaller than the cross-sectional area of the control surface 62. Although this relationship can be varied, a two-to-one relationship is contemplated here.

The piston head 56 is sealed in the bore 13 by means of a seal 70 provided in an annular groove 72 in the outer periphery of the piston head 56 to separate the bore 13 of the housing 12 into a first or pressure chamber 18 and a second or control chamber 20. An axial bore 15 is provided in the piston assembly 14 and is connected to the pressure chamber 18 by means of a first passage or port 66 and to the control chamber 20 by means of a port 67 and a second passage 68. A plug 69 is provided at the end of port 67. A counterbore 74 is provided in the open end of the bore 15.

The piston rod 58 is sealed in the bore 13 by means of sleeve 76 which separates the pressure chamber 18 from the reservoir chamber 22. The sleeve 76 is sealed to the bore 13 by means of an O-ring seal 78 provided in an annular groove 84 in the outer periphery of the sleeve to sealingly engage the bore 13 in the housing 12. The sleeve 76 is sealed to the piston rod 58 by means of an O-ring seal 75 provided in an annular groove 77 in the inner surface of the sleeve 76. Movement of the sleeve 76 within the bore 13 is prevented by means of a flange 86 provided on the outer periphery of the sleeve in a position to engage a shoulder 87 at the end of counterbore 28. Although the sleeve 76 is shown, the bore 13 in the housing 12 could be reduced at one end to provide the seal surface.

The bar or rod 26 is sealed in the central bore 44 of the end cap 36 by means of a rod seal 45 at the inner end and a rod wiper seal 47 at the other end.

Control Valve

In accordance with the invention and again referring to FIG. 2 of the drawings, the spool valve 16 is provided with first, second and third lands 88, 90 and 92, respectively. The first land 88 is sealed within the bore 15 of the piston assembly by means of an O-ring seal 94 positioned within a groove 96 in land 88. The flow of the fluid through the port 67 and passage 68 is controlled by means of the second land 90. The third land 92 acts as a guide to stabilize the movement of the spool valve 16 in passage 15 and is provided with flats 100 to form passages around land 92. The lands 88 and 90 are axially spaced to define an annular chamber 98. The lands 90 and 92 are axially spaced to provide an annular chamber 99. The flow of hydraulic fluid to and from the control chamber 20 is controlled by means of the second or control land 90.

As seen in FIG. 2, the control land 90 is positioned to control the flow of fluid through the port 67. Movement of the land 90 to the left will connect port 67 to annular chamber 98 allowing pressure fluid to flow from pressure chamber 18 through port 66 and annular chamber 98 into port 67. Movement of the land 90 to the right will connect port 67 to annular chamber 99 to allow fluid to flow from control chamber 20 through passages 68, port 67, annular chamber 99 and out to reservoir chamber 22 past flats 100 on land 92.

Means are provided to protect or isolate the O-ring seal 94 from the high pressure fluid in chamber 98 and to prevent extrusion of the O-ring seal. Such means is in the form of an axial passage 102 provided through the center of the spool valve 16 and connected at one end to the annular chamber 99 by a cross-bore 104 and to annular groove 106 in the first land 88 by means of a cross-bore 108. The open end of the passage 102 is closed by means of a plug 95. Hydraulic fluid under pressure in the annular chamber 98 which leaks past land 88 will be exhausted back to the reservoir chamber 22 through groove 106, cross-bore 108, passage 102 and cross-bore 104.

Concentricity Compensation

Since the concentric relation of the bore 38 in the end cap 32 and the bore 15 in piston assembly 14 varies, there is a tendency for the spool valve 16 to bind in the bore 15. In this regard, it should be noted that the input mechanism 24 includes an actuating member or rod 114 mounted in bore 38 and connected to the spool valve 16 by means of a flexible rod 110. The actuating member 114 is sealed in the bore 38 by means of an O-ring seal 33 provided in an annular groove 35. In this regard it should be noted. that the O-ring seal 33 is only exposed to the pressure of the fluid in chamber 22 which is at reservoir or tank pressure. This produces a long life in the seal by reducing friction between the seal 33 and the member 38. A rod wiper seal 47 can also be provided on the actuating member.

Variations in concentricity are compensated for by means of the resiliency of needle or rod 110 which is connected to the spool valve 16 by a set screw 112 and to the actuating or input rod 114 by set screws 116. Although the resiliency or flexibility of the rod 110 is small, there is sufficient flexibility to prevent binding of the spool valve within the bore 15 of the piston assembly 14.

Figure 4:
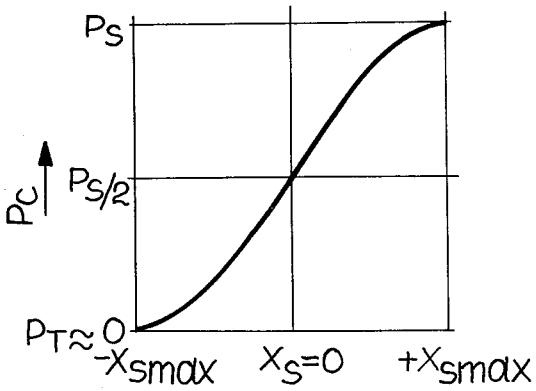
FIG. 4 is a pressure diagram showing the balanced force provided by the underlapped pressure passage.
Figure 3:
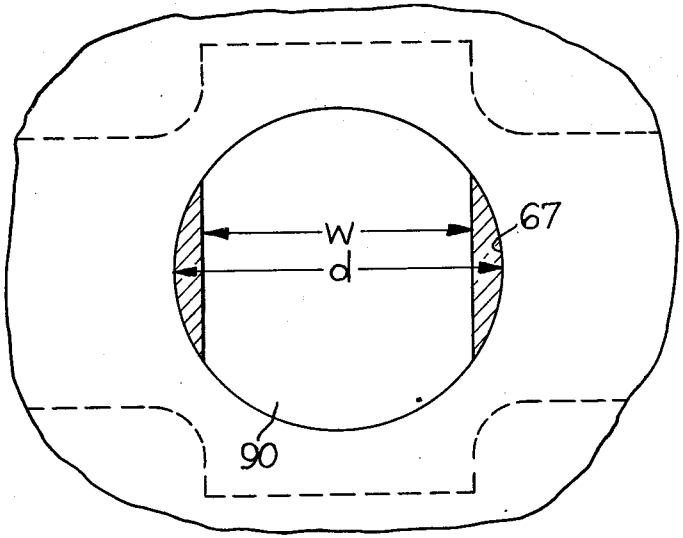
FIG. 3 is an enlarged view of the pressure passage showing the valve underlap.

FIGS. 3 and 4

Means are provided to assure constant balanced pressure across the piston head 56 when the spool valve is in the null position regardless of any change in system pressure. Such means as seen in FIGS. 3 and 4, is in the form of a valve "under-lap" provided between the control land 90 and the port 67. The width "w" of the land 90 is approximately .004 to .008 inches less than the diameter "d" of the port 67. A flow through path is thereby provided from chamber 98 across land 90 into chamber 99.

The graph shown in FIG. 4 represents the fluid pressure relation acting on the piston head 56 for various positions ($X_s$) of the spool valve 16 with respect to piston assembly 14. In the null or balanced position, Xs = 0, as shown in FIG. 3, the fluid pressure in port 67 will be equal to system pressure Ps divided by two or Ps/2. As spool valve 16 is moved to the right, the pressure in chamber 18 remains at constant system pressure as the pressure in chamber 20 drops toward tank pressure. When the spool valve 16 is moved to the left, the pressure in control chamber 20 will increase to system pressure while the pressure in the pressure chamber 18 will remain at system pressure. However, since the cross-sectional area of the control surface 62 of the piston head 56 is twice the cross-sectional area of pressure or work surface 60, the piston assembly 14 will move to the left. It should be apparent that in the null position with system pressure, Ps, in the pressure chamber 18 and one-half system pressure, Ps/2, in the control chamber 20, the piston assembly 14 will remain in a stationary position. With this arrangement, variations in system pressure will not cause any fluctuation in the position of the piston assembly 14 because the ratio of the pressure in chamber 20 to the pressure in chamber 18 will remain constant.

Spool Valve Pressure Balance

The spool valve 16 is pressure balanced in the bore 15 of the piston assembly 14 to eliminate any unbalancing force from acting on the spool valve 16. In this regard, the diameter of the actuator rod 114 and the land 88 are substantially equal. The bore 15 is vented to atmosphere through a passage 118 provided in the rod 26. Therefore, all forces acting on both the spool valve 16 and the actuator rod 114 are balanced.

In the event of a loss of fluid pressure to the spool valve, means are provided to mechanically actuate the piston assembly 14. Such means is in the form of a flange or collar 120 provided on the end of the actuating rod 114. The flange 120 is positioned in the counterbore 74 in the end of the piston rod 58 and is retained therein by a snap ring 122 provided in a groove 124 at the end of the counterbore 74. On movement of the actuating member 114 to the left, the flange 120 will engage the snap ring 122. On movement of the actuating member to the right the flange 120 will engage the end 125 of the counterbore 74. Sufficient space is provided between the flange 120, the end 125 and the retainer ring 122 to allow for normal fluid operation of the spool valve 16.

Resume

The proportional force amplifier of this invention is uneffected by variations in system pressure due to the valve underlap provided between the land 90 and the port 67. The pressure of the fluid in chamber 18 is maintained at a predetermined constant pressure by the pump 49 and relief valve 51. When the spool valve 16 is in the null position in the piston assembly constant pressure will also be maintained in chamber 20 through the under lapped land 90. Binding of the spool valve 16 in the bore 15 is prevented by the flexible connection of the actuating rod 114 to the spool valve 16. The spool valve is also pressure balanced in the bore 15 by venting the bore 15 to atmosphere through rod 26. Finally, the spool valve seal 94 and actuating rod seal 33 are protected from system pressure fluid to reduce friction between the seal 94 and the bore 66 and the seal 33 and the actuating rod 114.

I claim:

1. A proportional force amplifier comprising a housing having a cylindrical bore, a piston assembly positioned in said bore and separating said bore into first and second chambers, means in said cylindrical bore for defining a third chamber separate from said first chamber, a fluid inlet port in said housing connecting said first chamber to a fluid pressure source;

a fluid outlet port in said housing connecting said third chamber to a reservoir;

said piston assembly including a piston head having a working surface on one side positioned to respond to the pressure of the fluid in the first chamber and a control surface on the other side positioned to respond to the pressure of the fluid in the second chamber;

said working surface cross-sectional area being proportionately smaller than the cross-sectional area of the control surface;

an axial bore in said piston assembly having one end connected to said third chamber;

a first passage in said piston assembly connecting said first chamber to said axial bore;

a second passage in said piston assembly connecting said second chamber to said axial bore;

a spool valve positioned in said axial bore in said piston assembly, said valve including means for providing a continuous flow of fluid from said first passage through said bore to said second passage and to said third chamber whereby a predetermined pressure relation is maintained between said first chamber and said second chamber, said valve being selectively movable for connecting said second passage to one of the first passage or axial bore for discharge to the third chamber, said piston assembly moving in response to changes in pressure in said control chamber a distance equal to the distance of movement of said spool valve;

an actuating member positioned in said housing and being adapted for connection to an external input mechanism and means for resiliently connecting said spool valve to said actuating member to compensate for variations in concentricity between said actuating member and said spool valve.

2. The amplifier according to claim 1 wherein said resilient connecting means comprises a resilient rod having a diameter less than the diameter of said actuating member and said spool valve.

3. A proportional force amplifier according to claim 1 wherein said maintaining means includes first, second and third lands, said first land and said second land being spaced to define an annular pressure chamber and said third land and said second land being spaced to define an annular relief chamber, a seal in said first land positioned to sealingly engage said axial bore in said piston assembly;

an annular groove in said first land and a passage in said spool valve connecting said annular relief chamber to said annular groove.

4. The amplifier according to claim 1 wherein said maintaining means comprise a land on said spool valve having a width less than the diameter of said second passage.

5. The amplifier according to claim 3 wherein said actuating member and said first land having substantially equal cross-sectional areas and a vent passage in said piston assembly for venting the other end of said axial bore to atmosphere.

6. The amplifier according to claim 1 wherein said actuating member includes means for mechanically engaging said spool valve.

7. The amplifier according to claim 1 wherein said actuating member extends through said third chamber and including means in said housing for sealingly engaging said actuating member, said engaging means being subjected to the pressure of the fluid in said third chamber.

8. A proportional force amplifier comprising a housing having a cylindrical bore, a piston assembly positioned in said cylindrical bore and defining a fluid pressure chamber and a fluid control chamber, means in said bore for defining a fluid reservoir chamber separate from said fluid pressure chamber;

a fluid inlet port in said housing connecting said pressure chamber to a fluid pressure source and a fluid outlet port in said housing connecting said reservoir chamber to a fluid reservoir;

said piston assembly including a piston head having a working surface positioned to respond to the pressure of the fluid in the pressure chamber and a control surface positioned to respond to the pressure of the fluid in the control chamber;

said working surface being proportionately smaller than the control surface;

an axial bore in said piston assembly having one end connected to said reservoir chamber;

a first passage in said piston assembly connecting said pressure chamber to said axial bore;

a second passage in said piston assembly connecting said control chamber to said axial bore;

a spool valve mounted for axial movement in said axial bore, means on said spool valve for providing continuous flow of fluid from said first passage through said bore to said second passage and to said reservoir chamber whereby a predetermined fluid pressure relation is maintained between said pressure chamber and said control chamber;

and means for moving said spool valve with respect to said piston assembly to selectively connect said second passage to one of said first passages or said reservoir chamber whereby said piston assembly moves a distance equal to the distance of movement of said spool valve.

9. The amplifier according to claim 8 wherein said piston assembly includes means for venting the other end of said axial bore to atmosphere.

10. The amplifier according to claim 8 wherein said spool valve includes a first, second and third land, said first land being spaced from said second land to define an annular pressure chamber in communication with said first passage and said second land being spaced from said third land to define an annular relief chamber, a seal in said first land sealing said first land to said axial bore, an annular groove in said first land between said annular chamber and said seal, and passage means in said spool valve connecting said annular relief chamber to said annular groove in said first land.

* * * * *